United States Patent [19]

Romagnoli

[11] Patent Number: 4,559,755

[45] Date of Patent: Dec. 24, 1985

[54] DEVICE FOR FLEXOGRAPHIC PRINTING ON A STRIP OF PACKING MATERIAL IN PACKAGING MACHINES, PARTICULARLY FOR BLISTER PACKS

[75] Inventor: Andrea Romagnoli, Bologna, Italy

[73] Assignee: IMA Industria Macchine Automatiche SpA, Bologna, Italy

[21] Appl. No.: 575,940

[22] Filed: Feb. 1, 1984

[30] Foreign Application Priority Data

Feb. 23, 1983 [IT] Italy ..... 3347 A/83

[51] Int. Cl.[4] ..... B65B 61/02

[52] U.S. Cl. ..... 53/64; 53/131; 493/321; 493/188

[58] Field of Search ..... 53/131, 411, 65, 64; 493/321, 320, 325, 324, 188, 187

[56] References Cited

U.S. PATENT DOCUMENTS 3,293,824 12/1966 Dorr ..... 53/131
3,535,847 10/1970 Strohmeier et al. ..... 53/131 X
4,077,187 3/1978 Paxton ..... 53/131
4,263,845 4/1981 Okamura ..... 53/131 X
4,425,108 1/1984 Harrison et al. ..... 493/326 X

*Primary Examiner*—James F. Coan
*Attorney, Agent, or Firm*—Karl F. Ross; Herbert Dubno

[57] ABSTRACT

In the case of a packaging machine, in particular for blister packs, a device for flexographic printing on a strip of packaging having a continuous movement comprises a roll supporting a printing block of resilient material in plate form which is detachably associated with the said roll and an ink tray with which there is associated a plurality of inking rollers and so-called anilox rollers which is movable with respect to the said printing block support roll in order to distance the said anilox roll from the support roll together with roller means for pressing the strip against the said printing block support roll by means of control means operated by the means for controlling and stopping the packaging machine, the said printing block support rolls, inking roller and anilox being maintained in a movement of rotation when the said packaging machine is stopped.

3 Claims, 2 Drawing Figures

DEVICE FOR FLEXOGRAPHIC PRINTING ON A STRIP OF PACKING MATERIAL IN PACKAGING MACHINES, PARTICULARLY FOR BLISTER PACKS

FIELD OF THE INVENTION

The present invention relates to a device for flexographic printing on a strip of packaging material in packaging machines, in particular for blister packs.

BACKGROUND OF THE INVENTION

In the case of packaging machines using packaging or packing material in strip form supplied with a continuous movement, it is known that if the product to be packaged is to be provided with printed motifs on the packaging material, this strip is provided beforehand with these motifs whilst the machine is equipped with devices for centering the printing so that the said motifs are juxtaposed on the packaged product.

In the case of product packagings or wrappings which are to show, in addition to the above-mentioned motifs, on the packaged product the date of packaging or the date of expiry of the life of the product, these packaging machines must also be provided with devices designed to reproduce these further markings on the packaging material. This is, for example, the case with a known machine for packaging tablets or blister packs produced and sold by the applicant company under the Trademark IMA-C60 in which a strip of material which has been thermoformed with cells as it moves along the production line of the machine and is supplied with the products to be packaged in these cells is provided with a second strip, usually of aluminium, which may be connected to the first strip in order to close the packaging and which has all the said markings on its outer face.

OBJECT OF THE INVENTION

The applicant company proposes, by means of the present invention, to simplify these packaging machines which are complex per se, using all the advantages of flexographic printing for the printing of the second closure strip in its above-mentioned packaging machine for blister packs and overcoming, in practice, all the technical problems encountered in providing these complex machines with a device for flexographic printing by providing this device with a construction which enables it to operate completely in phase with every pause for the large number of checks to which these packaging machines are subject for the successful production of the products which they are designed to produce at high operating speeds.

SUMMARY OF THE INVENTION

The present invention relates to a device for flexographic printing on a continuous strip of packaging material which is supplied to the packaging machine, in particular for blister packs, of the type essentially comprising a flexographic printing block roll and a tray or container for the ink with a plurality of rolls, which are respectively inking rollers and so-called anilox ink conveyor rolls, which device is characterised in that the said flexographic printing block comprises an element of resilient material in plate form having on one of its faces all the motifs and markings to be printed and wherein its other face is self-adhesive so that it may be detachably applied to the printing block roll and in that the said container or tray for the ink supporting the said inking rollers and so-called anilox is movably supported with respect to the said printing block roll in order to space, under the action of control means commanded by the means for controlling and stopping the packaging machine, the said anilox roll from the printing block roll when the packaging machine is stopped, control means commanded by the said means for controlling and stopping the packaging machine also being provided to keep the said printing block roll and the said inking and anilox rollers in a movement of rotation when the packaging machine is stationary and to space from the said printing block roll which is moving the pressure roll means designed to hold the strip to be printed against the said printing block roll when the packaging machine is operative.

Using a construction of this type for the flexographic printing of the present invention obviously enables not only the complete exploitation of the advantages offered by flexographic printing in the case of packaging machines having a high production speed which are subject to fairly frequent stoppages as a result of the checks essential for maintaining the commercial requirements of the products produced thereby, but also the practical and economic advantage in the manufacture of these packaging machines resulting from the possibility of replacing on a daily basis the printing element of resilient material provided with all the markings required for its simple application, by self-adhesion, to the printing block roll with a further element having up-dated dates and markings as a result of the low cost of these printing elements.

BRIEF DESCRIPTION OF THE DRAWING

These and other characteristic features and advantages of the device for flexographic printing on a continuous strip of packaging material which is supplied to the packaging machine in accordance with the present invention are described in further detail in the following description of an embodiment thereof and its practical application to this packaging machine which is given solely by way of non-limiting example with reference to the attached drawings, in which.

SPECIFIC DESCRIPTION

Figure 1:
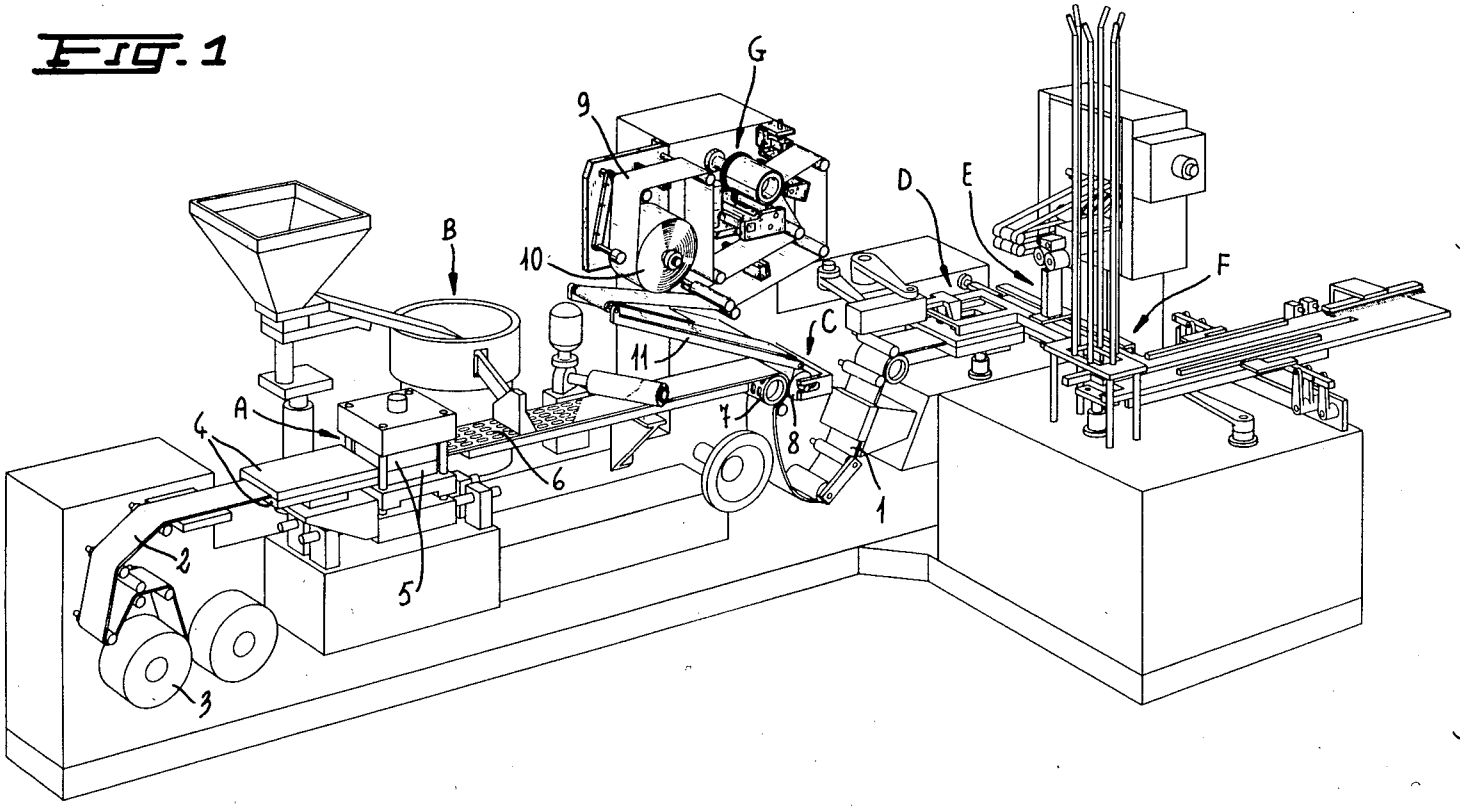
FIG. 1 is a perspective view of a packaging machine for blister packs provided with the flexographic printing device of the present invention which is shown in bold lines within this packaging machine for clarity of illustration.

The packaging machine shown is of the type, as mentioned above, designed to produce blister packs which is produced and sold by the applicant company under the Trademark IMA-C60 in which there is superimposed on a strip of material which is thermoformed with container blisters as it is supplied along the operating line of the machine and which is supplied with the products to be packaged in these container blisters a second strip, usually of aluminium, which is fastened to the first strip for the closure of the blister packs and which has printed on its outer face, in addition to the motifs for example of the company producing the packagings and/or the company which manufactures the machine or information concerning the product contained in the packagings, information such as the date of packaging or the date of expiry of the life of the said packaged product.

This packaging machine essentially comprises a base of elongate form along which a strip of blister packs 1 is obtained by supplying, along the horizontal production line of this packaging machine, a strip 2 of material which may be thermoformed and which is unrolled from a spool 3 and subjected to a sequence of operations along the said production line at a number of stations corresponding to the sequence steps, i.e. subjecting it in the first instance at a station A to a heating operation by means of heating plates 4 having a differentiated heating action, and then to the action of punching means 5 for the formation in the strip 2, in respective transverse and horizontal alignment, of blisters 6 for containing the individual products to be packaged (not shown in the attached Figures). The strip 2 formed in this way with blisters, during its feed movement along the said production line of the packaging machine and driven by the drive rolls 7 and 8, is caused to pass through a station B for the supply of the products to be packaged, which are disposed individually in the blisters as the strip moves forward, and then through a station C for the hermetic sealing of the said blisters each containing one of the products to be packaged, by means of the superimposition on the strip 2 of a second strip 9, usually of aluminium, which may be attached to the first thereby providing the continuous strip of blister packs 1.

This continuous strip of blister packs 1 is then either supplied to a further machine for subsequent processing, or supplied to a station D of the said packaging machine as shown in FIG. 1, at which it is separated into individual blister packs by cutting means and where the latter are gradually either stacked in accordance with the regular arrangement occupied during the separation stage, i.e. in normal superposition, so that they may, at the end of the operating cycle, be inserted in boxes at the station F after passing through a station E where an element, for example relating to the nature of the product itself, is associated with the stacks, or even supplied to a further machine for packing.

Figure 2:
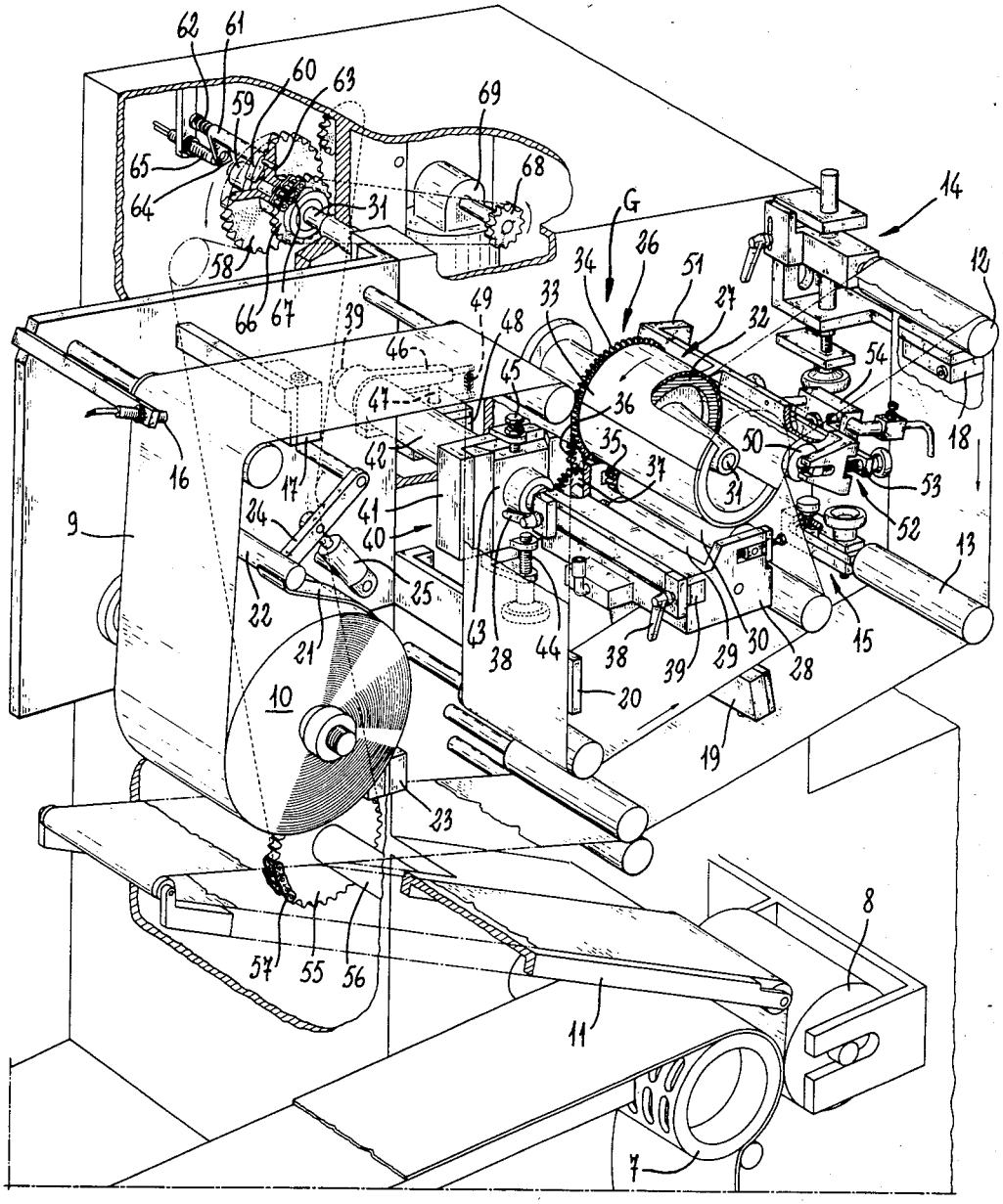
FIG. 2 is again a perspective view of the portion of this packaging machine of FIG. 1, on an enlarged scale, which contains the flexographic printing device of the invention with certain portions removed and other portions in cross-section for clarity of illustration.

The said closure strip 9, which is normally provided with its face which is designed to form the exterior of the blister pack already provided with printed motifs and therefore caused to pass through a station in which the above-mentioned information concerning the date of packaging of the product or the expiry of the life of the packaged product are printed, but wherein in accordance with the present invention all these motifs and markings are printed on this face of the strip by means of the flexographic printing device designed to equip these packaging machines in particular, is unrolled from a spool 10 and caused to pass along a production line with an irregular progression of the packaging machine so that it may be subjected to a printing operation at a printing station indicated by G and possibly to a preheating operation above a preheating plate 11 and then superimposed and attached to the strip 2 at the said station C for the hermetic sealing of the blisters 6. This irregular progression of the strip 9 is achieved by a plurality of guide rolls, of which the rolls indicated by 12 and 13 are disposed downstream of the printing station G and are adjustable, the first roll being adjustable in terms of spacing from the other roll by a device indicated overall by 14 and the second roll being adjustable axially by a device 15. Along the path of the strip 9 there is also provided a sequence of sensitive devices 16, 17, 18, 19 for respectively monitoring the end of the spool, the absence of the strip along its path, the presence or absence of the printing on the strip and the junctions for the continuity of the strip carried out by the operator at the plate 20 in order to enable those products which are provided therein to be removed as is usual with this type of machine. In order to control the unrolling of the strip 9 from the spool 10, there is draped on the latter a strip 21 (see FIG. 2) designed to exert on this spool 10 a pressure effect, which strip has its upper end fixed to a fixed arm 22 and a counterweight 23 at its lower end. An oscillating lever 24 controlled by an actuation cylinder 25 having a fluid dynamics effect is designed to lock the spool support shaft when the packaging machine is inoperative.

The flexographic printing device indicated overall by 26 and located at the said printing station G and constructed in accordance with the invention to equip packaging machines for printing of a continuous strip, for example a strip 9 in the case illustrated, comprises a printing block support cylinder 27 and a tray or container 28 for the ink provided with an inking roller 29 and a so-called anilox ink conveyor roller 30 designed to operate with the printing block supported by the said printing block support roll 27. This printing block support roll 27 is keyed on a shaft 31 supported by the base of the packaging machine and actuated within the said base by the actuation mechanism for the said packaging machine. This is constituted by a cylindrical roll 32 on which there is detachably fixed by adhesion the printing element 33 of resilient material in plate form, one of whose faces is self-adhesive and the other of whose faces is provided with the motifs and information mentioned above to be printed on the said strip 9. At its innermost end, i.e. the end closest to the base of the machine, the said cylindrical roll 32 is provided with a gear 34 in engagement with a first gear 35 with which the so-called anilox roller is provided, which roller is also provided, externally to the tray 28, with a second gear 36 in engagement with a gear 37 with which the said inking roller 29 is provided. The gear 36 is provided with a crude shape having a diameter which is slightly lower than that of the crude shape of the gear 37 so as to cause the anilox roller 30 to rotate faster than the inking roller 29 with a slight slipping or friction on this latter roller. The anilox roller 30 also has its outer cylindrical surface or jacket embossed as is conventional for these printing devices.

The tray 28 for the ink, provided with the said rollers 29 and 30, is detachably supported and may be locked by means of locking levers 38 on a portion projecting from a support shaft 39 supported, in turn, in a rotatable manner by a support 40 supported by the base of the packaging machine. This support 40 is constituted by a prismatic portion or head 41 and by a cylindrical portion 42 extending within the machine base. A body 43 whose operational position may be adjusted by means of adjustment screw means 44 in combination with catch screw means 45 is mounted in a vertically slidable manner on the said prismatic head 41. The said support shaft 39 passes through the body 43 and the cylindrical portion 42 of the support 40 and an end section of the shaft emerges from this latter portion 42, on which section there is mounted one end of a lever member 46 whose other end leads to the actuation rod 47 of a control unit 48 actuated by fluid dynamics and controlled by a control source which is not shown in the Figures. The end of this lever 46 which leads to the actuation rod 47 is attached to the body of the control unit 48 by a resistance spring 49.

On the right-hand side of the printing block support roll 27 in the Figures there is provided a roll 50 designed to hold the strip 9 in the operational position with respect to the printing block 33 when the packaging machine is operative and to enable its distancing when the packaging machine is inoperative as will be explained below. This roll 50 is supported such that it may be horizontally displaced by a support element 51 fixed to the base of the machine, with the opposite ends of its shaft connected to screws belonging to adjustment devices 52 supported by a horizontal strip 53 leading to the actuation rod of a second control unit 54 actuated by fluid dynamics supported by the support element 51 and also controlled by the above-mentioned control source (not shown).

As mentioned above, the shaft 31 supporting the printing block support roll 27 is actuated by the mechanism of the packaging machine and in particular derives its movement of rotation from a chain gear 55 keyed on the shaft 56, driven by the said mechanism, of the drive roll 7 for the strip 9. There is in fact wound on this chain gear 55 a transmission chain 57 which is also wound on a chain gear 58 mounted freely on the shaft 31 on which there is fixed a sleeve 59 having drive cogs with which there cooperate drive cogs 60 provided at one end of a tubular element 61 fitted in a resilient and free manner by means of a torsion spring 62 on a pin 63 fixed in a projecting manner on the periphery of the chain gear 58. The other end of the tubular element 61 supports a transducer 64 designed to cooperate with an inductor 65 supported in a fixed manner by the base of the machine so that the printing block roll 27 starts in phase with the packaging machine with respect to the pauses and starts of the packaging machine as will be described below. There is also keyed on this shaft 31 a chain gear 66 of the free release type which is known per se and which has a unidirectional drive action, on which there is wound a chain 67 which is also wound on a chain gear 68 keyed on the drive shaft of a motor reduction gear 69 controlled by the electrical control circuit of the packaging machine for the purpose described below.

The flexographic printing device described above, operates as follows:

When the packaging machine has been operationally adjusted and the start button of the machine has been actuated, the control unit 48 is released such that under the action of the spring 49, the anilox roller 30, which is in its spaced position with respect to the printing block roll 27 as will be described below, is brought into contact with the printing block roll 27 after which the motor reduction gear 69 which rotates the printing block roll 27 through one revolution is actuated until the transducer 64 passing in front of the inductor 65 stops it.

Meanwhile, by means of the control unit 54, the roll 50 pushes the strip 9 into contact with the printing block roll 27 and the machine begins to print on the strip 9 all the required motifs and information until it is stopped by any one of the plurality of devices for monitoring the integrity of the product which the machine itself is provided with.

In the case of stoppage of the machine the roll 50, and therefore the strip 9, is spaced, by means of the control unit 54, from the printing block roll 27, the motor reduction gear is brought into operation causing the rotation of the printing block roll 27, whilst the control unit 48 spaces the anilox roller 30 from the printing block roll 27 by rotating the ink tray 28 in the clockwise direction.

When the cause of the stoppage of the packaging machine has been removed, the machine is restarted by actuating the said start button and repeating the operational cycle described above for the printing device, the same sequence taking place whenever the packaging machine is stopped.

In practice it has been noted that with the continuous cycle flexographic printing device as constructed in accordance with the invention it is possible to make major economies and simultaneously to achieve high production speeds achieving all the above-mentioned objects.

The description of the flexographic printing device having a continuous cycle in question which is made with reference to the attached drawings and which is obviously only given by way of example may obviously be modified and varied in any way suggested by practice and by its use or exploitation in packaging machines in which a continous strip of packaging material is supplied, without departing from the scope of the attached claims.

I claim:

1. A device for flexographic printing on a continuous strip of packaging material in a packaging machine, said device comprising:

a flexographic printing block roll carrying a flexographic printing block in the form of an element of resilient material in plate form having on one of its faces all patterns to be printed and on its opposite face an adhesive for detachable application to said printing block roll;

an ink tray juxtaposed with said printing block roll;

at least one ink transfer roller mounted on said tray and rotatable for transferring ink to said printing block roll;

displacing means for movable supporting said tray relative to said printing block roll for shifting of said tray and said ink transfer roller away from said printing block roll;

control means responsive to the stopping of said packaging machine for activating said displacing means;

a pressure roll adapted to hold said strip against said printing block roll when said packaging machine is operating;

means connected to said control means for relatively spacing said pressure roll from said printing block roll when said packaging machine is inoperative; and means effective upon interruption of operation of said machine for continuing to drive said printing block roll and said ink transfer roller.

2. The device defined in claim 1, further comprising a second ink transfer roller rotatably mounted on said ink tray for transferring ink to the first-mentioned of said ink transfer rollers, said first and second ink transfer roller having a greater peripheral speed than said second ink transfer roller whereby a slippage is established between the respective peripheral surfaces of said first and second rollers, the peripheral surface of said first ink transfer roller being embossed and the peripheral surface of said second ink transfer roller being smooth.

3. The device defined in claim 1 wherein said displacing means for shifting said ink tray includes a first fluid-operated member, said means for spacing said pressure roll from said printing block roll includes a second fluid-operated member, and said means for continuing to drive said printing block roll and said ink transfer roller includes a motor reduction gear.

* * * * *